United States Patent [19]

Brown

[11] 4,401,226

[45] Aug. 30, 1983

[54] VENTING CLOSURE ASSEMBLY

[75] Inventor: Homer J. Brown, Oreland, Pa.

[73] Assignee: The West Company, Phoenixville, Pa.

[21] Appl. No.: 343,302

[22] Filed: Jan. 27, 1982

[51] Int. Cl.[3] ..... B65D 51/16

[52] U.S. Cl. ..... 215/250; 215/313

[58] Field of Search ..... 215/250, 313; 220/367

[56] References Cited

U.S. PATENT DOCUMENTS 1,890,347 12/1932 Voss ..... 215/313

*Primary Examiner*—Donald F. Norton

*Attorney, Agent, or Firm*—Eugene E. Renz, Jr.

[57] ABSTRACT

A venting closure for sealing a pressurized container comprising a stopper member having an elongated stem portion engageable in the discharge opening in the container, an enlarged head portion having a bottom chamber formed in its outer axial end face, a generally disc-like button rotatably mounted in said chamber having means defining a groove overlying a removable cap normally sealing a port in said stopper communicating with the interior head space of said container, vent channel means in said button, rotation of said button operable to displace the means normally sealing said port to establish fluid communication therethrough and permit venting from the head space to the atmosphere through said vent channel means in said button.

8 Claims, 11 Drawing Figures

VENTING CLOSURE ASSEMBLY

BACKGROUND AND SUMMARY OF THE INVENTION

The present invention relates to closures for sealing containers and specifically to cork or stopper for carbonated beverages such as champagne having novel features of construction and arrangement providing a tight tamper evident seal and including easily actuatable venting means for safely releasing internal pressure in the container before removing the closure.

Containers for certain carbonated beverages have to be sealed tightly so that they retain a certain amount of gas pressure generated as a beneficial or inherent feature of the product. Typically, when opening these containers for discharge of the product, the pressure within the container will be reduced to atmospheric and it is therefore also important to be able to control the initial release of gas pressure which resides in the head space between the closure and the product. If the pressure is released instantaneously, the force may be expanded to cause spraying product from the mouth of the container which is undesirable and may in some instances propel the closure which is typically a cork as a projectile which can cause injury to the user.

Venting type closures for containers are not new, per se. For example, the Luczak, et al. U.S. Pat. No. 3,717,276 shows a multi-piece closure for pressurized carbonated beverages and the like. The closure construction essentially comprises a plastic liner which seals the mouth of the container, an outer metal cap provided with a pull tab for a removable tear strip and a skirt which crimps under the container finish to seat and seal the liner against the container opening. An aperture in the liner provides a vent hole communicating with the interior of the container. There is also a network of vent channels in the liner in the form of radial grooves and an annular groove connecting the radial legs adjacent the skirt of the cap which normally are sealed by the metal cap about the periphery of the container opening by the crimped skirt. A tear strip is formed in the top panel of the cap across the corner radius and skirt by a continuous score line. The score line will increase the tendency of the metal to shear along that line so that the strip may be peeled back by a pull tab or ring fastened to the tear strip by a rivet near the forward end of the tear strip. It has been found that due to glass finish imperfections and non-uniform crimping action, there may develop small leakage paths permitting venting prematurely. This is, of course, harmful in the case of carbonated beverages like champagne since the product must be maintained pressurized until ready for consumption. Furthermore, the closure is not truly tamperproof by visual examination since there is the possibility of slight lifting of the skirt of the outer cap with an instrument creating a venting path to the interior of the container through the vent channels in the linear and central opening in the liner in direct flow communication with the channels. Lastly, this closure can be prematurely activated to produce a venting action if the pull tab is actuated inadvertently.

There are other closure assemblies which are also of interest. For example, the Smythe U.S. Pat. No. 248,360, issued Oct. 18, 1881, shows a cork with a passageway that mounts a filter. Ludamen, U.S. Pat. No. 329,920, issued Nov. 10, 1885, shows a bottle stopper. In one form of the invention, the stopper has a severable portion which is cone-shaped and normally seals the bottle discharge opening. The user severs the cone-shaped top to permit the discharge of contents and then inverts the cap to stopper the opening for temporary closures during storage and the like. Haldig, U.S. Pat. No. 1,502,775, issued July 29, 1924 shows a safety closure for pressurized vessels simply consisting of a cork having a very narrow central opening that communicates with the contents and a paper disc for normally sealing the opening in the core. The opening is of a capillary dimension to prevent the loss of fluid from the container. However, if internal pressures develop as a result of fermentation, the pressure bursts the paper rather than blowing the cork.

With the foregoing in mind, it is an object of the present invention to provide a relatively simple and economical venting closure for containers for carbonated beverages and the like which effectively seals the container prior to use and is easy to manipulate to release the pressure in a hazard free manner.

Another object of the present invention is to provide a two piece closure with such venting function that is simple, efficient, easy and economical to assemble and operate.

DESCRIPTION OF THE DRAWINGS

These and other objects of the present invention and the various features and details of the operation and construction thereof are hereinafter more fully set forth with reference to the accompanying drawings wherein.

DESCRIPTION OF THE PREFERRED EMBODIMENTS

Figure 2:
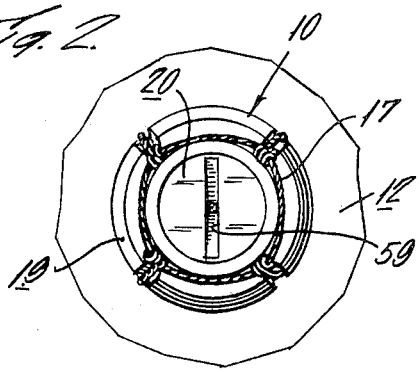
FIG. 2 is a top plan view thereof.
Figure 4:
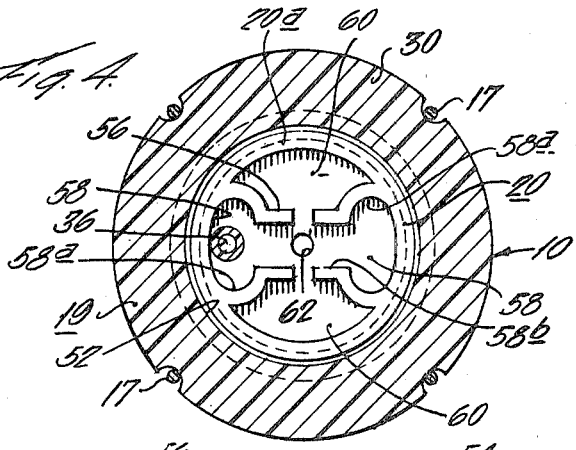
FIGS. 4, 5 and 6 are sectional views taken on lines 4—4, 5—5 and 6—6 respectively of FIG. 3.
Figure 1:
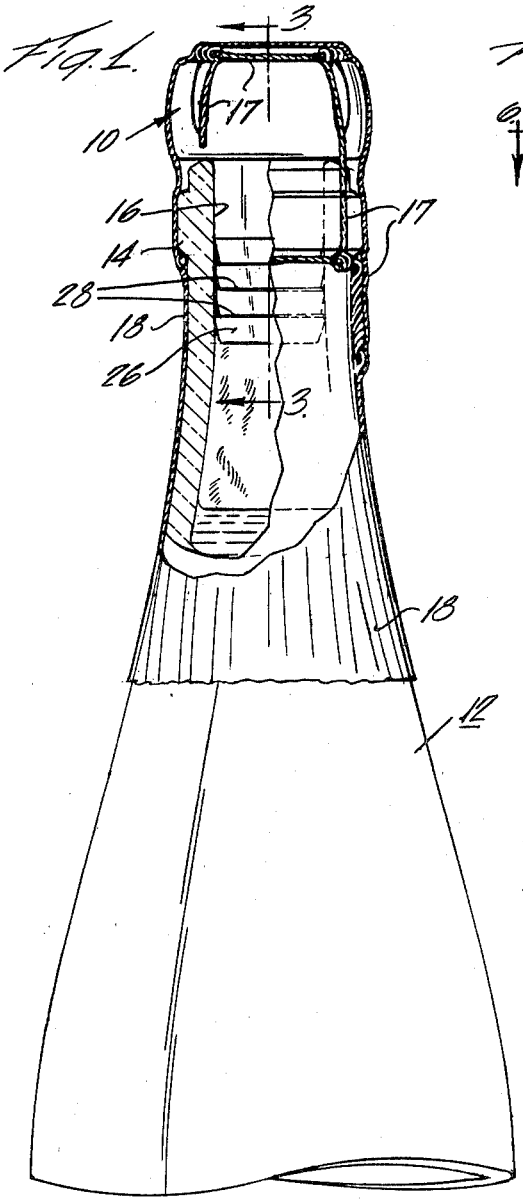
FIG. 1 is a fragmentary side elevational view partly in section of a container such as a champagne bottle with a venting closure applied thereto which is constructed in accordance with the present invention.
Figure 3:
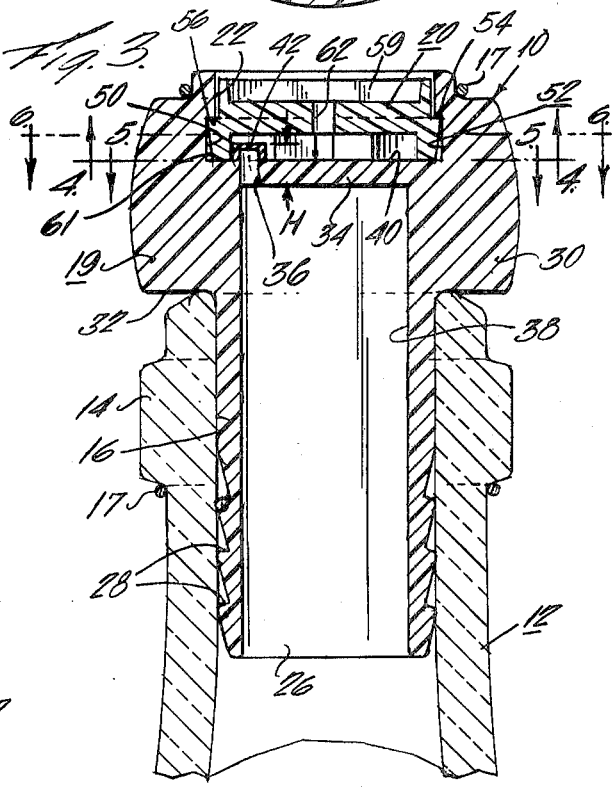
FIG. 3 is an enlarged transverse sectional view taken on the line 33 of FIG. 1 showing details of the closure assembly.
Figure 5:
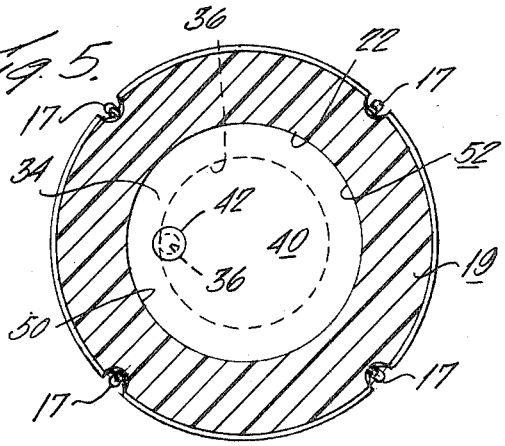

Referring now to the drawings and particularly to FIGS. 1–4 thereof, there is shown a venting closure generally designated by the numeral 10 for sealing a container for carbonated beverages such as a champagne bottle 12. The bottle 12 is of typical construction and has a finish or bead 14 adjacent the discharge opening 16.

The closure assembly further includes a conventional bale wire 17 and an overwrap 18 made of lead foil or the like which is snugly crimped over the closure 10, bale 17 and neck of the bottle as illustrated.

Figure 6:
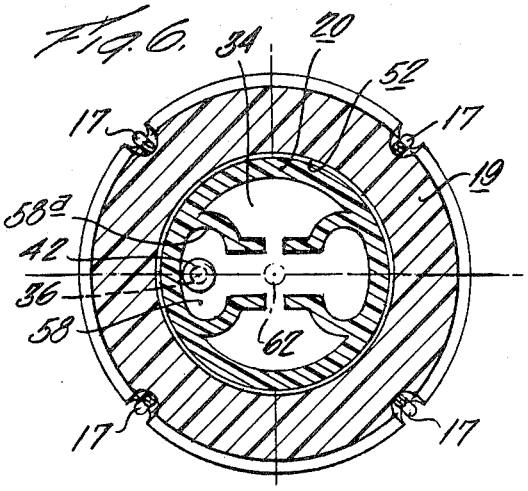
Figure 7:
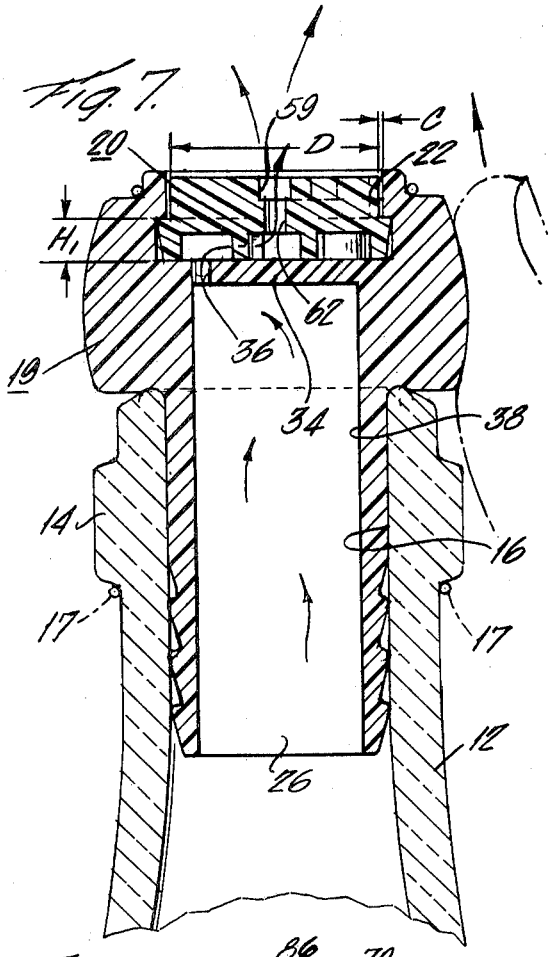
FIG. 7 is a transverse sectional view similar to FIG. 3 showing the parts of the closure in a venting position.
Figure 6A:
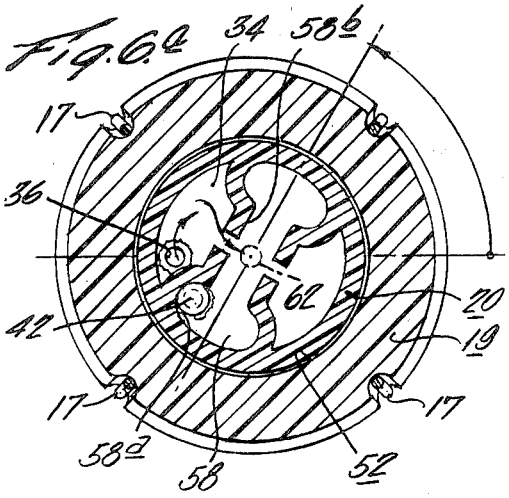
FIG. 6*a* is a sectional view similar to FIG. 6 showing the button of the two piece closure in a first position for affecting venting.

The closure 10 which is preferably made of a semi-rigid plastic material, such as polyethylene, comprises two elements, a cork like stopper member 19, and a disc-like button 20 mounted in a chamber 22 formed in the stopper 19 and rotatable therein between a sealing position (FIG. 6) and a venting position (FIGS. 6*a* and 7). The stopper 19 has an elongated hollow stem portion 26 with a series of axially spaced, circumferentially extending ribs 28 which snugly seats in the discharge opening 16 in the bottle 12 in the manner shown and an enlarged head portion 30 of a greater cross section than the stem 26 having a lower face 32 which seats on the axial end face of the bottle in the assembled position. Note the head portion 30 extends radially beyond the container finish to provide means after venting for removing the closure by a prying action as illustrated in FIG. 7. A wall portion 34 is located in the head portion and separates the button chamber 22 from the hollow stem 26. A capped axial through port 36 is provided in the wall portion 34 and is located adjacent the outer periphery of the opening 38 in the stem. Note that the port 36 extends slightly above the top face 40 of the wall 34 in the integral cap 42 normally closing the port 36 and projects into the venting button chamber 22. The cap 42 is severable as explained later and is therefore comparatively thin walled in the order of 0.010 inches thick. Further, the height H of the opening in the cap 42 is preferably rather small to preclude resealing action, the height above the top face of the wall portion 34 being in the order of 0.040 inches.

The button chamber 22 is of a greater diameter than the stem opening 38 and as illustrated has a stepped peripheral side wall 50 defining a circumferentially extending internal pocket 52 within which the button 20 engages with a snap fit. The button 20, which is also made of a plastic material, such as polyethylene, snugly seats in the chamber 22 and has a circumferentially extending outer peripheral rib 54 which engages under the top shoulder surface 56 in the annular pocket 52 to retain the button in the chamber and still permit rotational movement therein. Note the diameter D of the button above the rib 54 is slightly smaller than the diameter of the top portion of the button chamber 22 providing a peripheral clearance C to ease turning the button in the chamber.

In the present instance, the bottom face 20*a* of the button has a dividing wall configuration 56 defining a generally bar bell shaped slot or groove 58 and generally trapezoidal slots or grooves 60. Further, as illustrated, the button has a central axial opening 62 communicating with the double bayonet slot or bar bell shaped slot 58 in the lower face of the button.

As illustrated, the wall 56 has grooves 66 connecting the barbell slot 58 and trapezoidal slots 60 located adjacent the central opening 62. The curvature of the bar bell portions 58*a* of slot 58 conform generally to the peripheral surface of cap 42 for port 36 to provide a good shearing action when the button is rotated for venting as explained in detail below. Also the height $H_1$ of button 20 between its bottom face 20*a* and shoulder 56 of the pocket 52 is such as to firmly seat and press the bottom face of the button against the top face 40 of divider wall 34.

Considering now assembly and operation of the venting closure of the present invention. The stopper 19 and button 20 are separately molded by conventional means and then the button 20 is simply positioned over the button chamber 22 with the cap 42 normally sealing port 36 aligned with either bell portion 58*a* of the bar bell slot 58 and simply pressed into place. The symmetrical bar bell slot arrangement permits assembly in two positions. A turn slot 59 in the top face of the button aids in aligning it properly for assembly since it lies parallel to the bar 58*b* of the bar bell slot 58. Note also the outer bottom edge of the button is feathered or tapered as at 61 to permit snap assembly into the chamber. The closure 10 is now ready for application to a filled bottle 12 simply by pressing the stem 26 into the opening 16 until the head portion 30 bottoms on the axial end face of the container. The bale 17 is applied and the overwrap 18 assembled to complete the assembly operation. Note that in this condition the stopper seals the contents and that the vent button cannot be turned to a venting position without giving visual evidence of tampering. Thus the assembly may be termed truly tamperproof.

When it is desired to open the bottle, the foil overwrap 18 is removed exposing the venting button 20 which then can be rotated from its normal sealing position in either direction which action causes the arcuate wall of the bell portion 58*a* to engage and then sever the slot cap 42 to immediately establish fluid communication through the port 36, either slot and central opening 62 to atmosphere thereby releasing the internal pressure as indicated by the flow arrows in FIG. 7. The firm abutment of the button with the top face 40 of the wall 34 insures a good shearing action of the port cap 42 and prevents override. When the container has been vented, the bale 17 is removed and the stopper pried loose by lever type action with the thumb. To assist in rotating the button, the top face is formed with a slotted opening 59 for insertion of a coin or the like, The upper edge of the head portion may be provided with visual indicia to assist the user in rotating the button to the correct position for venting.

Figure 9:
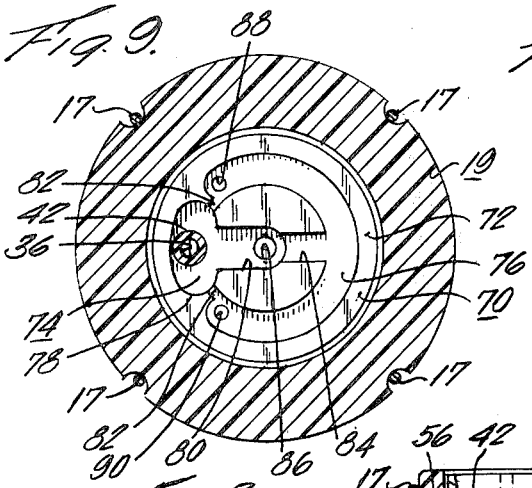
FIGS. 9 and 10 are sectional views taken on lines 9—9 and 10—10 of FIG. 8.
Figure 10:
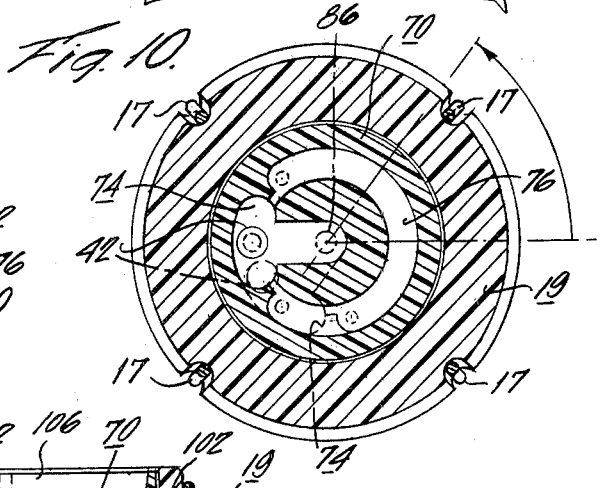
Figure 8:
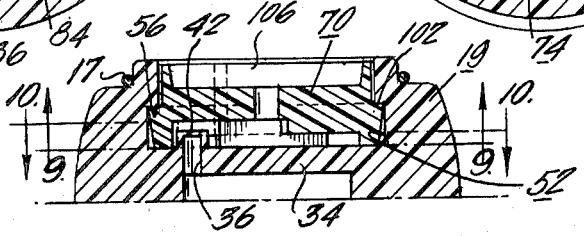
FIG. 8 is a fragmentary sectional elevational view similar to FIG. 3 showing another embodiment of venting closure in accordance with the present invention.

There is illustrated in FIGS. 8–10 inclusive another embodiment of venting closure in accordance with the present invention. The stopper is of generally similar construction to that described previously and therefore, the same reference numerals have been applied. The button 70 however, even though it operates in essentially the same way as that described previously, is of a different configuration in terms of flow channels formed therein and the arrangement of vent ports or holes. In the present instance, the bottom face 72 of the button 70 has a generally T-shaped slot or pocket 74 formed therein and a horseshoe shaped or generally U-shaped groove 76 extending from the outer terminal ends of the cross piece 78 of the T and encompassing the vertical leg 80 thereof. The U-shaped groove 76 and T-shaped channel 74 have short, very shallow connecting passages 82 at their juncture at the cross piece and a short shallow connecting channel 84 at the base of the T. Three axially extending ports 86, 88 and 90 are provided in the button, one port 86 located centrally thereof at the base of the T and the other two ports 88 and 90 located at the opposite terminal ends of the U-shaped slot. The opening 36 in the wall 34 separating button chamber from the hollow stem cavity is located relative to the center of the chamber so that it communicates with either the T-shaped slot 74 or the horseshoe-shaped groove 76 in any position of the button so that once the cap 42 for port 36 has been severed in the manner described above, there is venting through the button in any angular position of the button in the chamber as explained in detail below.

Consider now manufacture, assembly and operation of the venting closure in accordance with the present invention. The stopper and the button may be easily fabricated by mass production techniques from a plastic such as polyethelene. The button 70 is easily assembled to the stopper initially simply by positioning it at the top of the buttom chamber with the boss or cap 42 aligned with the T-shaped slot 74 and then the button 70 is simply pressed in axially whereby the peripheral rib 102 seats under the shoulder 56 in the annular pocket 52. The bale 17 and foil overwrap 18 are assembled as described above. Now when it is desired to vent the pressure in the head space, the foil 18 is removed and the button 70 is simply rotated in the chamber 22 in either direction, which after a comparatively short angular displacement severs the cap 42 for vent port 36 from the wall 34 establishing fluid communication paths to atmosphere through the opening 86 and the network of grooves in the bottom face of the button. Similar to the previously described embodiment, the top of the button is provided with an elongated slot 106 which is aligned with the T-slot 74 in the bottom face and indicia means may be provided on the stopper to show when the button is in a sealing position. A second visual indicia may be provided to indicate the angular position where the cap 42 is severed.

It is noted that preferably the bale is removed after the stopper has been vented in the manner described above. However, users may choose to remove the bale and then the entire stopper assembly without venting to produce the characteristic popping sound when removing the cork-type stopper.

Even though particular embodiments of the present invention have been described herein, it is not intended to limit the invention and changes and modifications therein can be made within the scope of the following claims.

What is claimed is:

1. A venting closure for sealing a pressurized container comprising a stopper member having an elongated stem portion engageable in the discharge opening in the container, an enlarged head portion having a button chamber formed in its outer axial end face, a generally disc-like button rotatably mounted in said chamber having means defining a groove overlying a removable cap normally sealing a port in said stopper communicating with the interior head space of said container, vent channel means in said button, rotation of said button operable to displace the cap normally sealing said port to establish fluid communication therethrough and permit venting from the head space to the atmosphere through said vent channel means in said button.

2. A venting closure as claimed in claim 1 wherein said vent channel means in said button comprises a bar bell shaped slot in the bottom face of said button confronting said removable cap and a pair of generally trapezoidally shaped slots on either side of said bar bell shaped slot and connecting passages in the wall defining said bar bell slot.

3. A venting closure as claimed in claim 1 wherein said vent channel means in said button comprises a generally T-shaped slot in the bottom face thereof having a portion overlying said removable cap and a U-shaped slot having channel means connecting to said T-shaped slot and three axial openings in said button, two communicating with said U-shaped slot and one communicating with said T-shaped slot.

4. A venting closure as claimed in claim 1 wherein said stopper member and button are made of a semi-rigid plastic, such as polyethelene.

5. A venting closure as claimed in claim 1 wherein said chamber is of stepped configuration and the periphery of said button has a circumferentially extending rib engageable with a circumferentially extending shoulder formed by said chamber to firmly seat the bottom face of the button against the wall of said chamber.

6. A venting closure as claimed in claim 5 wherein the button is of a smaller cross section than said chamber above said rib to facilitate turning of the button in the chamber.

7. A venting closure as claimed in claim 1 wherein the peripheral sidewall of said button is tapered slightly inwardly to facilitate assembly of said button in said chamber by a snap fit.

8. A venting closure as claimed in claim 1 including a slotted opening in the top face of said button to facilitate rotation of the button to sever the removable cap normally sealing said port.

9. The combination comprising a necked container having a discharge opening, a stopper member having an elongated stem portion engageable in the discharge opening in the container, said stopper having an enlarged head portion having a button chamber formed in its outer axial end face, a generally disc-like button rotatably mounted in said chamber having means defining a groove overlying a removable cap normally sealing a port in said stopper communicating with the interior head space of said container, vent channel means in said button, rotation of said button operable to displace the cap normally sealing said port to establish fluid communication therethrough and permit venting from the head space to the atmosphere through said vent channel means in said button, bale means engaging over said head portion and container neck and an overwrap encapsulating said stopper and bale.

* * * * *